US005473124A

United States Patent [19]

Yazici et al.

[11] Patent Number: 5,473,124

[45] Date of Patent: Dec. 5, 1995

[54] PACKLESS SILENCER

[75] Inventors: Muammer Yazici, Etobicoke; Werner Richarz, Ottawa, both of Canada

[73] Assignee: Dipti Datta, Mississauga, Canada

[21] Appl. No.: 189,573

[22] Filed: Jan. 31, 1994

[51] Int. Cl.[6] ..... E04F 17/04

[52] U.S. Cl. ..... 181/224; 454/906

[58] Field of Search ..... 181/217, 218, 181/224, 225, 229, 268, 272, 275, 282; 454/906

[56] References Cited

U.S. PATENT DOCUMENTS

| | | | |
|---|---|---|---|
| 2,994,401 | 8/1961 | Bourne et al. | 181/224 |
| 3,426,866 | 2/1969 | Jensen . | |
| 3,435,911 | 4/1969 | Greenheck . | |
| 3,511,336 | 5/1970 | Rink et al. | 181/224 |
| 4,287,962 | 9/1981 | Ingard et al. . | |
| 4,418,788 | 12/1983 | Gorchev et al. . | |
| 4,660,676 | 4/1987 | Eustace . | |
| 4,872,528 | 11/1989 | Goplen . | |
| 5,166,479 | 11/1992 | Gras . | |

FOREIGN PATENT DOCUMENTS 1423986 2/1976 United Kingdom .

OTHER PUBLICATIONS

Noise and Vibration Control, 1971 by Leo Baranek, pp. 246–248, published by McGraw–Hill.

*Primary Examiner*—Khanh Dang

*Attorney, Agent, or Firm*—Gifford, Krass, Groh, Sprinkle, Patmore, Anderson & Citkowski

[57] ABSTRACT

A non-fibrous acoustic silencing duct member capable of attenuating noise associated with a gaseous medium passing through it. Perforated sidewalls define a gas flow passageway and include at least two opposing walls, each perforated with a number of small holes distributed over its surface. Exterior sidewalls are positioned on the outside of the perforated sidewalls and are spaced therefrom. Enclosed chambers are formed between the perforated and exterior sidewalls, which chambers are of selected depths. One or more screen layers extend along and adjacent to outer surfaces of the perforated sidewalls, these screen layers being located in the chambers. Each screen layer is covered with an array of very small holes that are substantially smaller than the holes in the adjacent perforated sidewall. Internal dividers extend between each perforated sidewall and its respective exterior sidewall in order to divide the space between the sidewalls. In a preferred embodiment, the perforated sidewalls are made of sheet steel and the screen liners are metal screens.

35 Claims, 9 Drawing Sheets

192
193
179
204
205
206
198
207
202
176
184
200
194
190
180
196
182
178
181
195

PACKLESS SILENCER

BACKGROUND OF THE INVENTION

This invention relates to acoustic silencers capable of attenuating noise associated with a gaseous medium passing through the silencer or duct.

Silencers for air ducts and air delivery systems are known with conventional silencers generally employing sound attenuating fibrous material such as fibreglass bats. Generally, in a conventional silencer, which may be constructed to replace a section of a duct, the interior sidewalls that form the sides of the air passageway are made of perforated metal sheets having a large number of holes distributed over their surface. Behind each perforated sheet there is placed a fibrous, acoustically absorptive bat of material which may comprise fibreglass, as indicated or rock wool or even foam. In order to hold this bat of material in place there is normally also an exterior sheet metal wall which is imperforate. Preferably the interior perforated sheet is made to provide optimum sound access from the air flow passage to the sound attenuating material. For example, the open face area of the interior sheeting can be 20% or more.

However, it is recognized that these conventional silencers do result in some problems, particularly when used for certain applications. For example, the fibrous material of the packing can erode when the gas or air is flowing at high velocity, thus making the silencer eventually less effective. Also, the fibrous material is known to absorb toxic or flammable substances or even undesirable microorganisms with the passage of time. In the event of fire, some types of acoustic packing material may provide fuel for the fire or may give off toxic gases.

So called "packless silencers" are also known in the heating, ventilating and air conditioning industry. One form of packless silencer is described in U.S. Pat. No. 4,287,962 issued Sep. 8, 1981 to Industrial Acoustics Company. In one version of this silencer, there is a four sided silencing duct having a pair of opposed facing panels with a generally flattened semi-elliptical shape. The opposing flat portions of each panel are perforated sheets and the holes in these sheets open to chambers formed behind each panel. These chambers are separated by acoustically opaque and fluid impervious dividers or partition walls. Also, the facing panels have curved end portions which are non-perforated and thus acoustically opaque. The facing panels are made from galvanized or stainless steel or even from a non-metallic (but stable) material. The open area created by the perforations in the centre wall portions is in the range of 2 to 10% and the perforations are required to have a diameter in the range of from 0.032 inch to 0.125 inch with the panels having a thickness of from 26 gauge to 11 gauge.

It is an object of the present invention to provide an improved and alternative form of acoustic silencer suitable for use in a duct system, which silencer does not require the use of fibrous packing and which can be constructed to be highly effective at reducing the noise level passing through the duct.

It is a further object of the present invention to provide an improved acoustic silencer which employs a combination of perforated sidewalls and one or more screen layers extending along outer surfaces of the perforated sidewalls, with enclosed chambers being formed behind the perforated sidewall and screen.

It is a further object of the present invention to provide an improved acoustic silencer for use in a airflow duct for attenuating noise which does not employ fibrous sound attenuating material and which at the same time is relatively simple to construct and manufacture and requires little maintenance.

SUMMARY OF THE INVENTION

According to one aspect of the invention, a non-fibrous acoustic silencing duct member capable of attenuating noise associated with a gaseous medium passing through the duct member includes perforated sidewalls at least partially defining a gas flow passageway, these sidewalls including at least two opposing walls, each of which is perforated with a number of small holes distributed over the surface of the wall. There are also exterior sidewalls positioned on the outside of the perforated sidewalls and spaced therefrom with enclosed chambers being formed between the perforated and the exterior sidewalls, these chambers being of selected depth. One or more screen layers extend along and adjacent to outer surfaces of the perforated sidewalls and these layers are located in the chambers. Each screen layer is covered with an array of very small holes that are substantially smaller than the holes in the adjacent perforated sidewall. Means are provided for firmly attaching each screen layer to its respective interior sidewall. Internal dividers extend between each perforated sidewall and its respective adjacent exterior sidewall in order to divide the space between the sidewalls into two or more of the chambers.

In the preferred embodiment, the perforated sidewalls are made of sheet metal and the screen layers are metal screens.

According to another aspect of the invention, an acoustic silencer for use in an airflow duct for attenuating noise passing along the duct includes perforated sidewalls defining and surrounding an elongate airflow passageway having an inlet at one end of the sidewalls and an outlet at an opposite end thereof. These sidewalls have a large number of small holes distributed over their surfaces. Exterior sidewalls extend around the outside of the perforated sidewalls and are spaced therefrom. There are means for mounting the perforated sidewalls in the exterior sidewalls. At least one screen layer is mounted on an outer surface of each perforated sidewall away from the airflow passageway and this layer is formed with very small holes extending over its surface. These holes are substantially smaller than the holes in each perforated sidewall. There are also enclosed chambers formed between the perforated sidewalls and adjacent exterior sidewalls.

According to a further aspect of the invention, a sound attenuating duct unit for transmitting an airflow along an air duct comprises a housing having sidewalls surrounding an airflow passageway, an air inlet at one end of the passageway and an air outlet at the other end thereof. The sidewalls include interior perforated walls extending along and defining the airflow passageway. These interior walls have a large number of small holes distributed over their surfaces. At least one layer of screen material is disposed along an outer surface of one or more of the interior perforated walls away from the airflow passageway. The sidewalls form enclosed chambers located along the outer surface of the one or more interior perforated walls.

Preferably, the chambers are substantially hollow and contain no non-metallic fibrous material.

Further features and advantages will become apparent from the following detailed description taken in conjunction with the accompanying drawings.

DETAILED DESCRIPTION OF PREFERRED EMBODIMENTS

Figure 1:
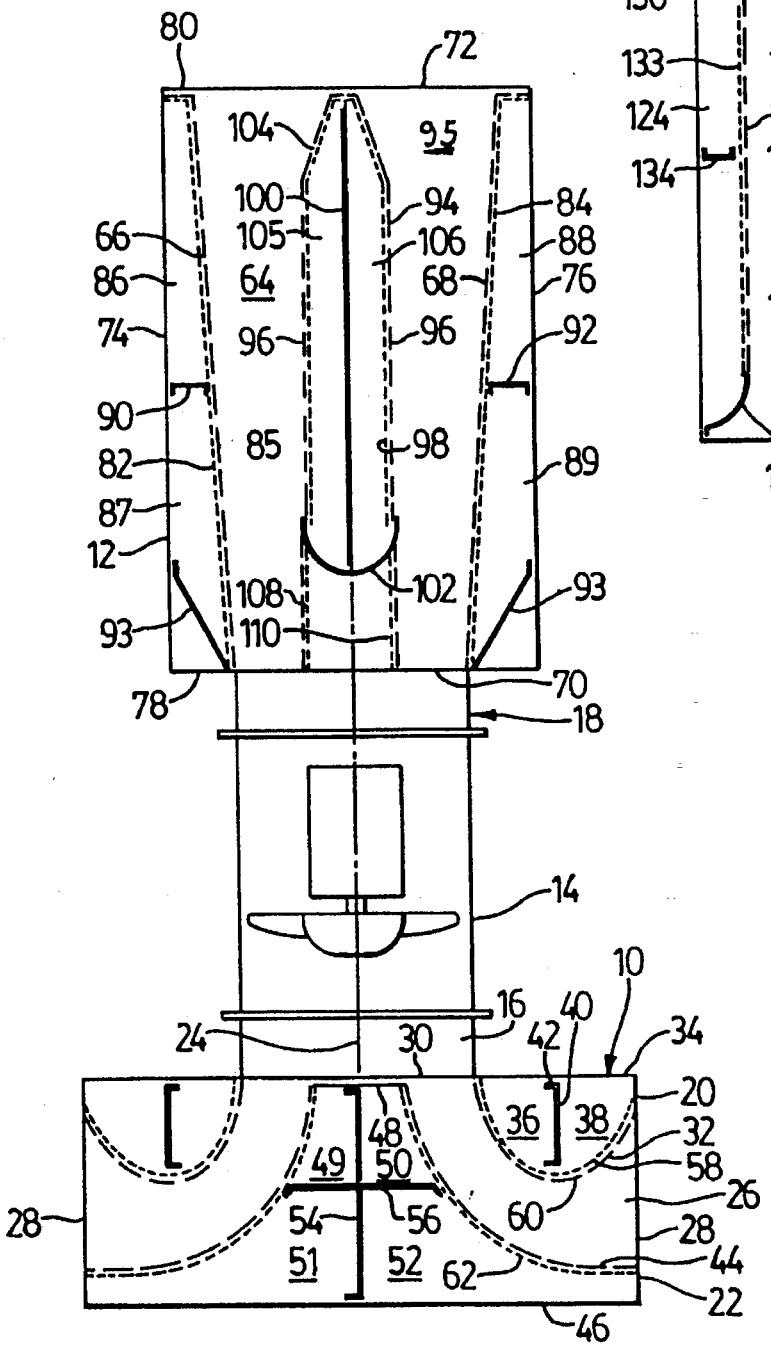
FIG. 1 is an axial cross-section of one form of air handling structure that includes an inlet silencer, an axial fan and an outlet silencer, the inlet and outlet silencers being constructed in accordance with the invention.

FIG. 1 illustrates one form of inlet silencer 10 and an outlet silencer 12 that can be used in conjunction with an axial fan unit 14 suitable for supplying air to or recirculating air in a large building or other structure. In a known manner, the axial fan unit is sealably connected to the inlet silencer and the outlet silencer by means of flexible connectors at 16 and 18.

The inlet silencer 10 acts both as a unit for directing and funnelling airflow entering the fan unit and as a silencer capable of attenuating noise associated with the fan and the airflow. The inlet silencer comprises an upper or outer section 20 and a lower or inner section 22 with both these sections being substantially axially symmetrical about a vertical axis indicated at 24. The inlet silencer has a gas flow passageway 26 that extends from an airflow inlet 28 which is annular and which extends symmetrically about the axis 24 and an air outlet 30. The outer or upper section 20 is substantially hollow and has a rounded, perforated interior sidewall 32. This sidewall is perforated with a number of small holes distributed over its surface in a manner known per se. An exterior sidewall 34 is positioned on the outside of the perforated sidewall 32 and is spaced therefrom. These sidewalls form enclosed chambers 36 and 38, which chambers are of a selected depth as explained hereinafter. The chambers 36 and 38 are separated by internal dividing means 40 which may comprise a flat, imperforate metal plate formed with connecting flanges 42. The dividing plate 40 extends between the perforated sidewall 32 and its respective, adjacent exterior sidewall 34 and is provided to prevent sound waves from travelling directly from one side of the space between these sidewalls to the other side of this hollow space. It will be understood further that the chambers 36 and 38 are preferably divided into relatively short empty chambers extending about the circumference of the annular space formed by the sidewalls as explained further hereinafter.

The lower section 22 has a generally funnel-shaped interior perforated sidewall 44. This interior wall is perforated in substantially the same manner as the interior wall 32. Located on the outside of and below the interior wall 44 is an exterior sidewall 46 made of imperforate metal sheet. Also, at the upper end of the wall 44 is an imperforate, circular metal plate 48. As shown in FIG. 1, enclosed chambers 49 to 52 are formed between the perforated interior wall 44 and the exterior sidewall 46. These chambers are separated by internal dividers indicated at 54 and 56, these dividers serving the same purpose as the aforementioned divider 40. In addition to the vertical divider 54 shown in FIG. 1, it will be understood that there can be a further, vertical divider that extends along the axis 24 but which is perpendicular to the divider 54. In this way, at least eight enclosed chambers are formed between the interior wall 44 and the exterior wall 46.

In accordance with the invention, one or more screen layers 58 extend along and adjacent to the outer surface of the perforated sidewall 32. The screen layer or layers are located in the chambers 36 and 38. Each screen layer is covered with an array of very small holes that are substantially smaller than the holes 60 in the adjacent perforated sidewall. There are means for firmly attaching the one or more screen layers to its interior sidewall. For example, the screen layers, which are preferably metal screens, can be spot welded to the sidewall. Alternatively, these screen layers can be attached by means of pop rivets to the sidewall. It is also possible to use fastening strips of metal (not shown) which are placed behind the screen layers and which are connected, such as by welding, to the interior sidewall. These strips of metal can be about one half inch wide and can be 20 gauge steel or lighter.

In a similar fashion, one or more screen layers 62 extend along and are adjacent to the outer surface of the perforated sidewall 44. Thus, the screen layers 62 are located along one side of chambers 49 to 52. The number of screen layers 58 or 62, the material from which the screens are made and the mesh of the screen are determined in a manner described hereinafter. These variables are selected by the designer of the system so as to achieve the desired sound attenuation.

The outlet silencer 12 has a gas flow passageway 64 which is straight and elongate. The transverse cross-section of the passageway formed by interior perforated sidewalls 66, 68 can either be circular from the inlet or input port 70 to the outlet 72 or the cross-section can gradually change from circular to square or rectangular. Exterior sidewalls 74, 76 extend around the outside of the perforated sidewalls and are spaced therefrom. There are means for mounting the perforated sidewalls in the exterior sidewalls including suitable end panels 78, 80 that extend around or along the aforementioned inlet and outlets 70 and 72 respectively. As in the construction of the inlet silencer 10, the perforated sidewalls each have at least one screen layer 82, 84 mounted on an outer surface thereof away from the airflow passageway 64. Again, the screen layer or layers are formed with very small holes extending over its or their surface, these holes being substantially smaller than the holes 85 in the sidewalls 66, 68.

Enclosed chambers 86 to 89 are formed between the perforated sidewalls 66, 68 and the adjacent exterior sidewalls 74, 76. These chambers are separated by interior imperforate dividers 90 and 92. In the illustrated version, there are also diagonally extending interior wall sections 93, the purpose of which is to avoid parallel walls for the chambers 87 and 89.

In the illustrated outlet silencer 12 there is mounted in the center of passageway 64 a central, flat-sided splitter 94 which helps to reduce sound generated by the airflow. The splitter 94 has two perforated sidewalls 96 which are flat for most of the length of the member, and which extend from one sidewall of the silencer to the opposite sidewall indicated at 95. The sidewalls 96 are backed with at least one screen layer 98 located on the surface of the sidewall away from the airflow. The splitter 94 has a central, non-perforated dividing wall 100 which extends along the central axis of the passageway 64 for the entire length of the member 94. The wall 100 again acts to prevent or reduce direct sound transmission between opposite sidewalls 96. The splitter or silencing member 94 preferably has a rounded semicylindrical upstream end 102 made of imperforate sheet material and a tapered downstream end 104 made of perforated sheet material backed with one or more screen layers. It will be further appreciated that in addition to the dividing wall 100 shown in FIG. 1, a further dividing wall can be mounted in the member 94 at right angles to the wall 100, thereby dividing the internal space of the member 94 into four enclosed chambers, two of which are indicated at 105 and 106.

If desired, a cylindrical airflow member 108 can extend from semicylindrical front end plate 102 to the inlet 70 of the unit. This member 108 is also made from perforated sheet metal backed by one or more screen layers indicated at 110.

In an alternative construction for the outlet silencer, the member 94 can be a cylindrical silencing member or "bullet" rather than a splitter. In this version, the imperforate plate 102 would be eliminated. The member 94 would then extend along the central axis of the airflow passageway from the inlet end at 70.

Although only one axial cross-section of the outlet silencer 12 is shown, it will be appreciated that an axial cross-section taken at 90 degrees to the illustrated cross-section can be of identical configuration and layout. Although the perforated interior wall defining the passageway 64 at least initially is circular in transverse cross-section, the exterior walls 74, 76 can be planar so that the exterior of the unit is a box-like housing that can be easily mounted to an adjoining support structure (not shown).

Figure 2:
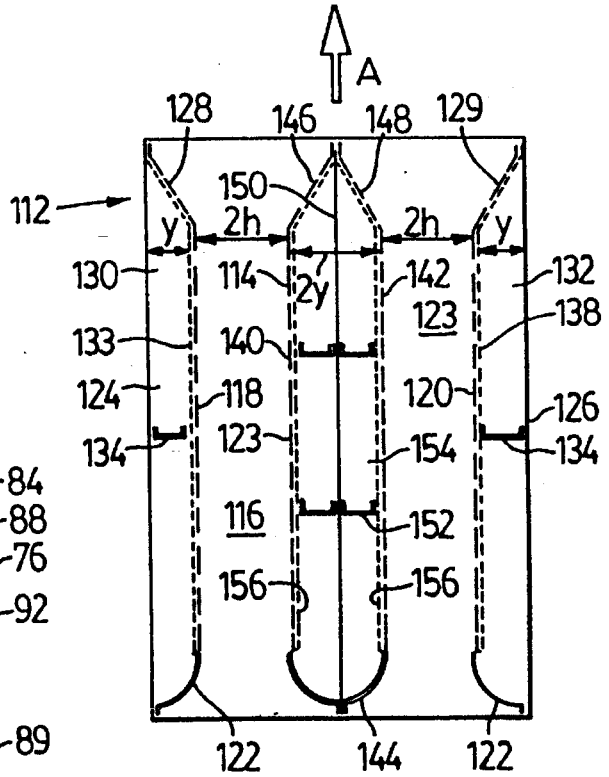
FIG. 2 is a longitudinal cross-section of a duct silencer with a splitter, said silencer being constructed in accordance with the invention.

FIG. 2 illustrates an acoustic silencer designed to be mounted in an airflow duct. This silencer 112 is equipped with a single splitter 114 centrally located in airflow passageway 116. The silencer is in the form of a four sided duct member. Within this duct member is positioned a pair of opposed facing panels 118 and 120 which are made of perforated sheet metal. The air flow through this duct member is intended to be in the direction indicated by the arrow A. At the inlet end of the silencer, there is a rounded imperforate front section 122 that connects the leading edge of perforated sidewall 118 or 120 to an adjacent exterior sidewall 124 or 126. The downstream end of each interior wall 118, 120 is bent inwardly at 128, 129 so that the rear edges of these interior walls are rigidly connected to the exterior walls 124, 126. It will be understood by one skilled in this art that a primary reason for the rounded front sections 122 and the sloping ends at 128, 129 is to achieve aerodynamic air flow. Enclosed chambers 130, 132 are formed between the perforated interior walls and the exterior walls 124, 126. One or more screen layers 133, 138 extend along and adjacent to outer surfaces of respective perforated sidewalls 118, 120. Again, these screen layers are firmly attached, such as by welding or pop rivets to the respective interior sidewalls. Preferably internal dividers 134 extend between the perforated sidewalls and their respective exterior sidewalls in order to divide the intervening space into two or more of said chambers. The dividers 134 are acoustically opaque and imperforate.

The duct member 112 including the facing panels 118, 120 can be made from galvanized or stainless steel. Stainless steel is preferred for the facing panels if the screen layers are to be welded thereto. The perforated sheet metal forming the panels 118, 120 can have an open area of about 23%. In a preferred embodiment of this silencer, internal dividing walls 134 are positioned approximately one foot apart along the length of the silencer, allowing at least one foot from the last internal divider to the adjacent end of the silencer.

Although the duct silencer 112 shown has only two of its sidewalls constructed as shown with interior perforated walls 118, 120, the other two sidewalls 123 comprising only exterior walls of the silencer, it is possible but more expensive to have perforated interior walls on all four sides of the silencer.

The splitter 114 has parallel, perforated facing panels 140 and 142 adjacent the gas flow passages. At the front of the splitter is a semi-cylindrical, imperforate nose section 144 connected at its opposite ends to sidewalls of the silencer. The facing panels 140 and 142 are bent inwardly at their downstream end, thereby forming end sections 146 and 148 which are perforated and which meet along the central longitudinal axis of the silencer. An acoustically opaque, central divider 150 extends the length of the splitter parallel to panels 140, 142. Again, interior dividers 152 can be used to split up the interior space of the splitter into a number of chambers 154. One or more screen layers 156 extend along and adjacent to inner surfaces of the perforated panels 140, 142, these screen layers being similar to the screen layers 133. Alternatively, the silencer can be composed of multiple full splitters (i.e. item 114) and no side cavities, such as those behind plates 118 and 120.

Figure 3:
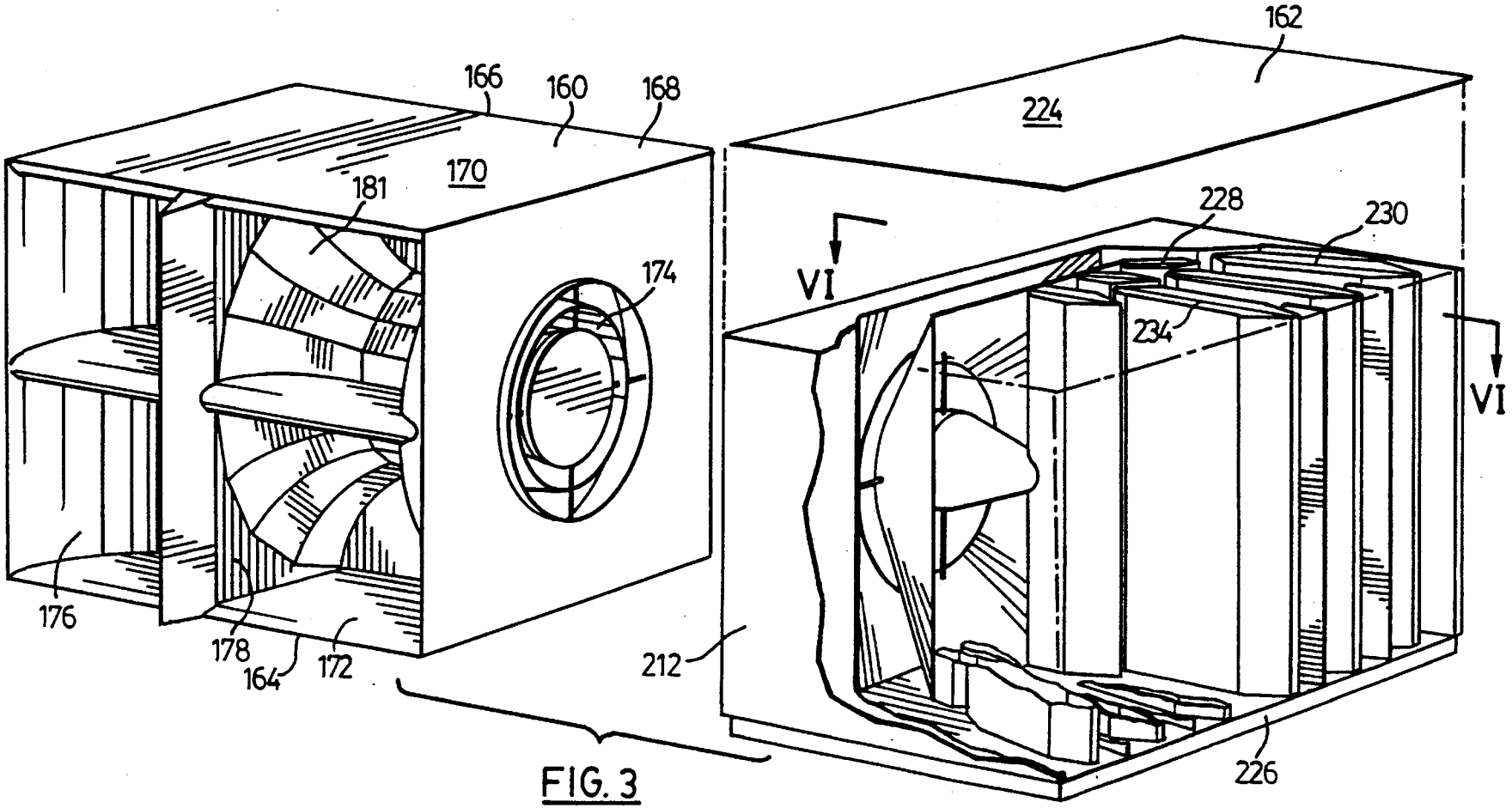
FIG. 3 is a perspective view showing the outlet ends of another embodiment of inlet silencer and outlet silencer constructed in accordance with the invention, the top panel of the outlet silencer being exploded and the outlet silencer being broken away for purposes of illustration.
Figure 4:
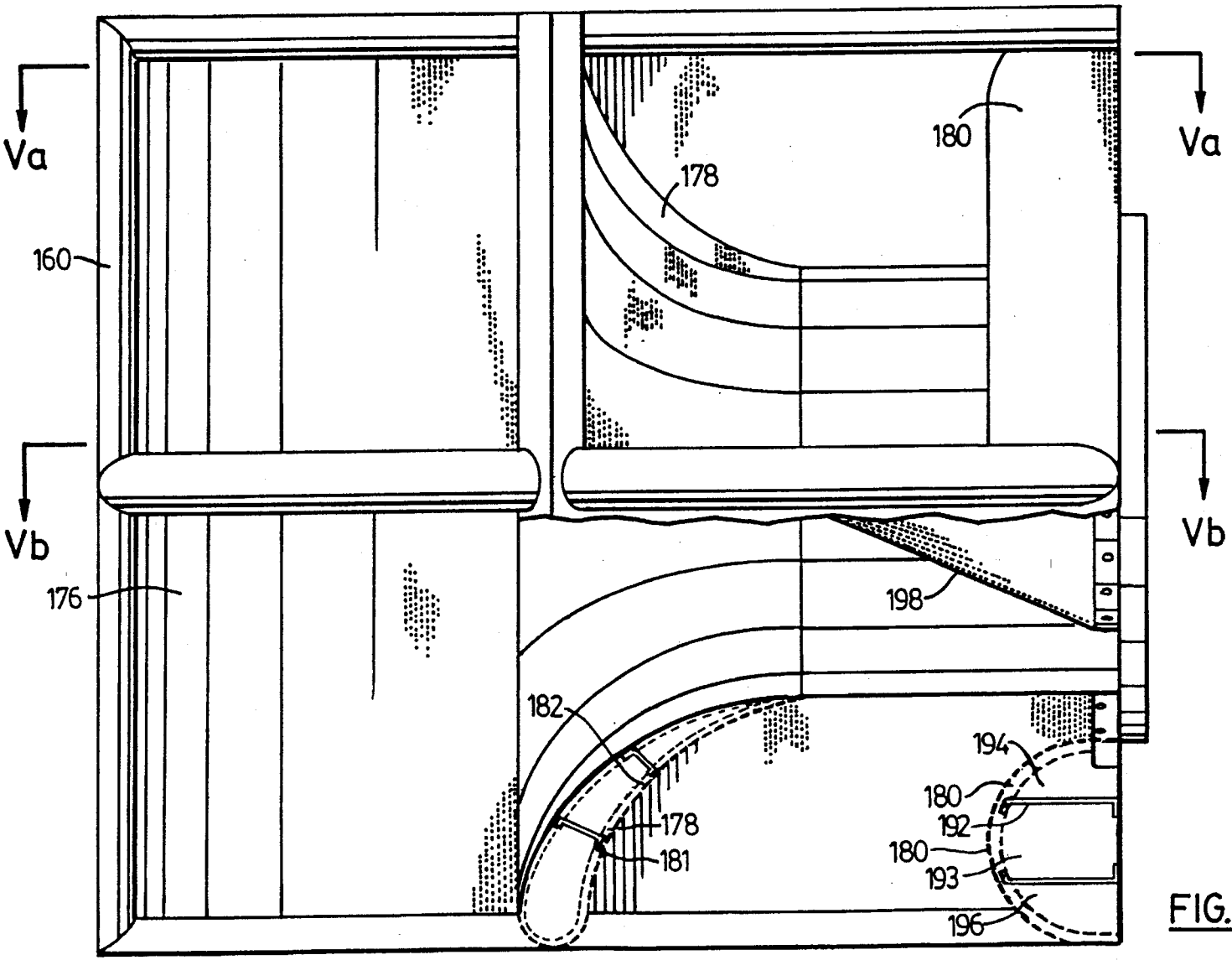
FIG. 4 is a side elevation, partly in cross-section, showing the inlet silencer of FIG. 3 (in the lower half, a central interior wall has been broken away to reveal an inner air passage and a cone member)
Figures 5A, 5B:
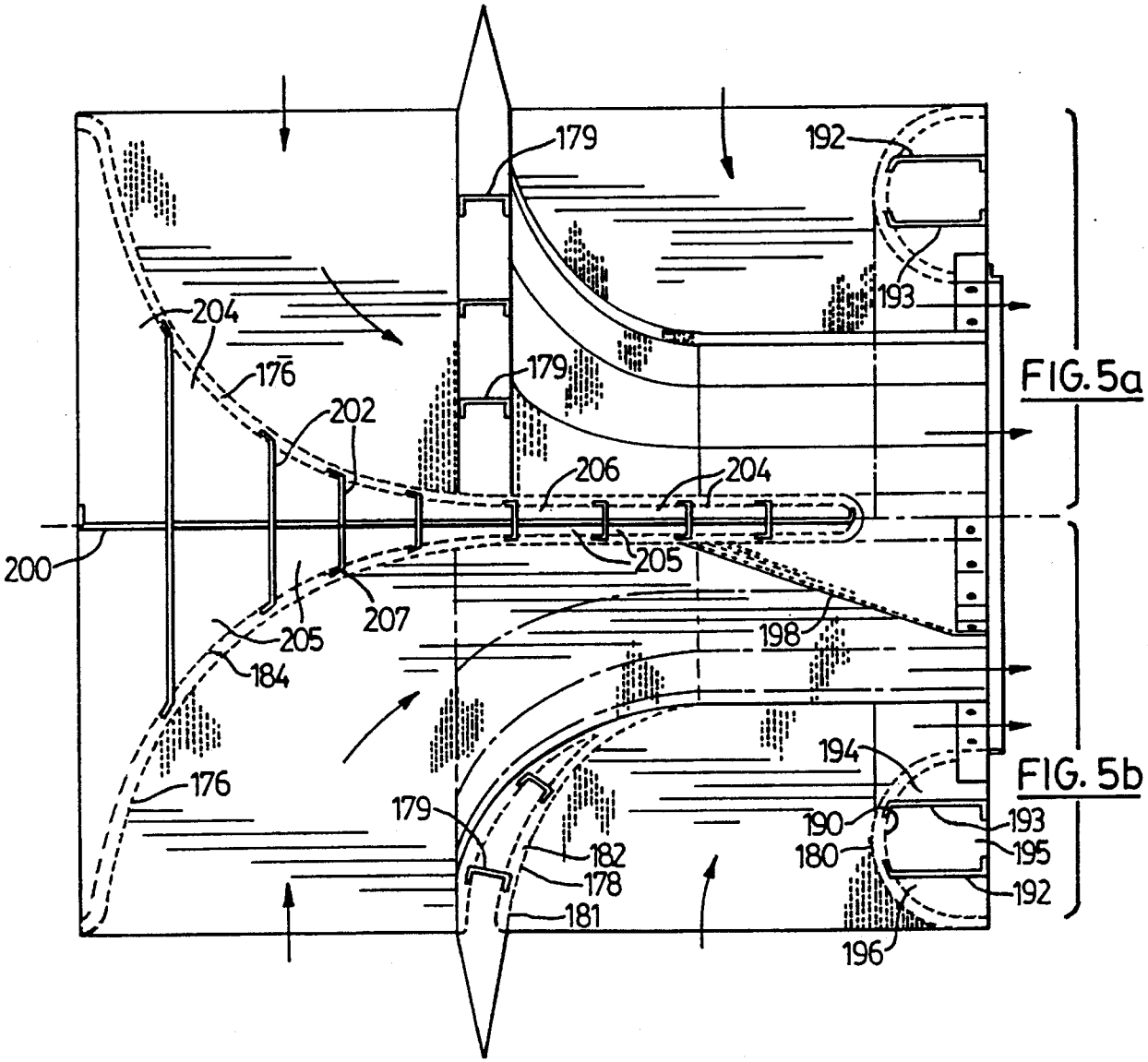
FIG. 5*a* is one half of a composite section of the inlet silencer of FIGS. 3 and 4 taken along the line Va—Va of FIG. 4.
FIG. 5*b* is the other half of the composite section of the inlet silencer taken along the line Vb—Vb of FIG. 4 showing the flat floor of the upper section and in chain dot lines the outline of the passageway above the plane of the section.

FIG. 3 shows an inlet silencer 160 and an outlet silencer 162 constructed generally in accordance with the teachings of applicant's copending U.S. patent application Ser. No. 08/072,590 filed Jun. 4, 1993, now U.S. Pat. No. 5,426,268, the specification of which is incorporated herein by reference. However, as explained hereinafter, the construction of these silencers is modified in accordance with the present invention so that they are non-fibrous acoustic silencers using one or more screen layers extending behind the perforated interior sheet metal walls. In the inlet silencer 160 incoming air enters from opposite vertical sides 164 and 166. The exterior side walls of the unit form a box like housing 168 having a top 170 and a bottom 172 which may rest on the floor or other suitable horizontal supporting surface. In an end wall of this housing is a single annular air outlet 174 which is adapted for connection to a fan unit. The airflow passageways are defined by interior walls 176, 178 and 180 and these passageways curve about 90 degrees from the two principal inlets to the outlet. At least sections of these walls are made of perforated sheet metal backed by at least one or more layers of screen material as shown in FIGS. 4, 5*a* and 5*b*. The interior wall 178 is formed with perforated metal sheeting at 181, which sheeting is backed with at least one or more layers of screening at 182. The wall 178 is subdivided into a number of enclosed chambers by imperforate sheet metal dividers 179. The interior wall 176 is also formed with perforated sheet metal backed with at least one or more layers of screen material indicated at 184. The interior wall 180 which forms an annulus that is semi-circular in cross-section is made of perforated sheet metal backed with at least one or more layers of screen material 190. The annular space formed by the wall 180 is divided in two by a single central divider (not shown) or in three by annular dividers 192, 193 as shown. These divider separate three annular chambers 194 to 196.

The inlet silencer 160 is also provided with a central airflow defining member in the form of a conical plate 198. The wide end of this member is located at the outlet 174. This conical plate is made of perforated sheet metal backed by at least one or more layers of screen material and it forms an enclosed conical chamber which is preferably subdivided by internal dividers 197 and 199 (see FIG. 6).

The two interior walls 176 form an enclosed space which is subdivided into enclosed chambers by means of a number of interior dividers 200, 202. These dividers form a number of chambers 204, 205 which are substantially hollow and located on opposite sides of central divider 200.

Figure 6:
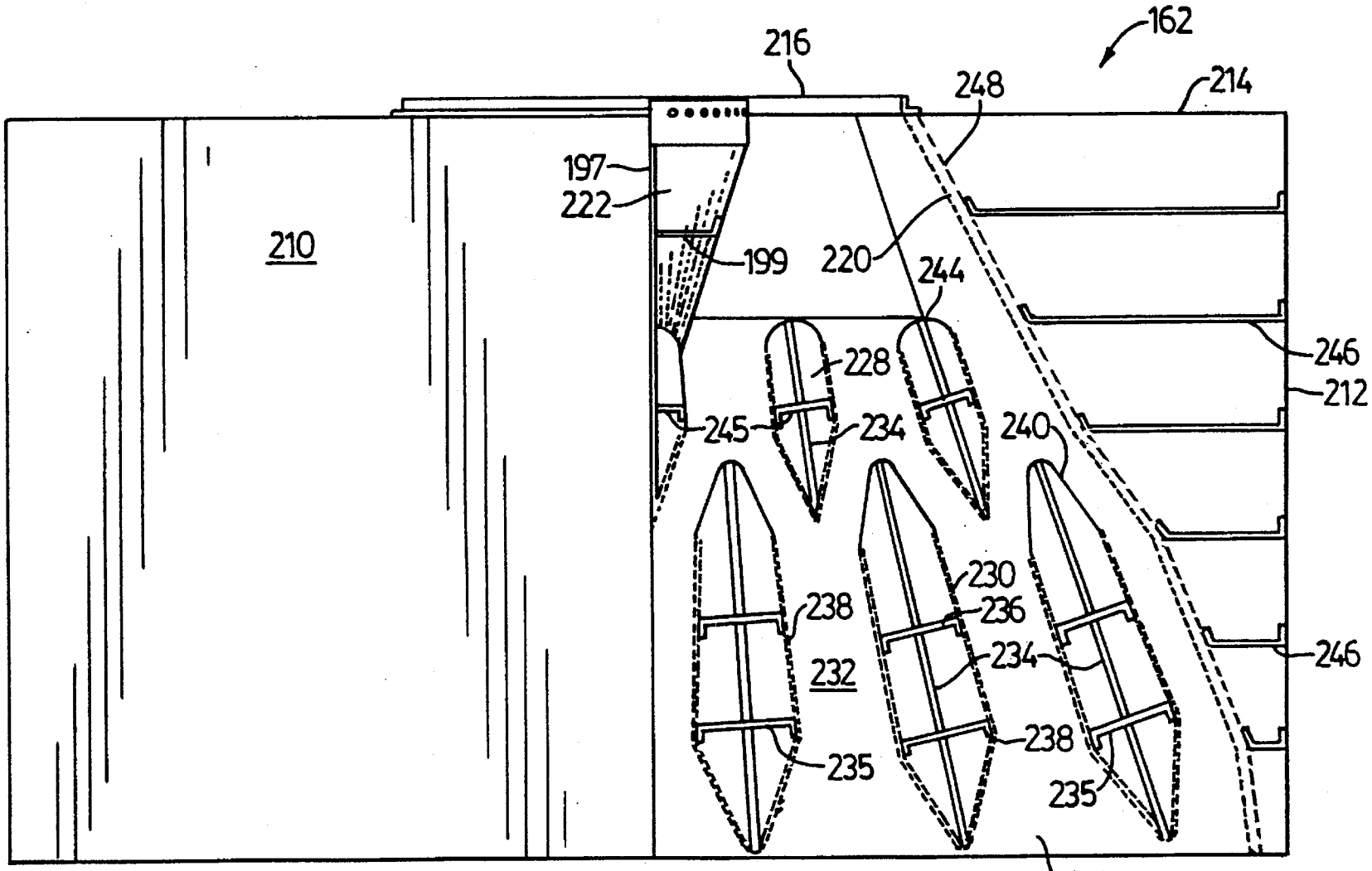
FIG. 6 is a plan view of the outlet silencer of FIG. 3 constructed in accordance with the invention with one half of the view in cross-section along the line VI—VI of FIG. 3.

Turning now to the outlet silencer 162 shown in FIGS. 3 and 6, which is connected to the outlet side of a fan unit (not shown), it has an exterior housing 210 with exterior sidewalls 212, a front end wall 214 containing an air inlet 216 and a rectangular air outlet 218. The inlet and outlet are connected by a main airflow passageway defined in part by perforated interior walls 220 of the housing.

The outlet silencer contains a central airflow defining member 222 which is preferably conical and located at the inlet. The member 222 is also made of perforated sheet metal, again backed with one or more layers of screen material. It is hollow except for internal dividers 197, 199 forming several enclosed chambers.

The outlet silencer 162 has a top side wall 224 and a bottom sidewall 226. Between these two walls or panels extend at least first and second series of air stream splitters 228 and 230 with the splitters of each series being spaced apart to form smaller air passageways 232. Each splitter is divided internally into a number of enclosed chambers by means of central dividing panel 234 and transverse dividers 235. The exterior walls of each splitter is formed primarily of perforated sheet metal 236 and all or substantially all of this perforated sheet metal is backed with one or more layers of screen material indicated at 238. However, the nose area of each splitter is preferably made of imperforate sheet material. In the embodiment of FIG. 6 this nose area 240 is generally triangular in horizontal cross-section. The smaller upstream splitters can have semi-cylindrical or rounded nose sections 244. The nose sections can be made from 18 gauge sheet metal. The use of imperforate metal in a nose region has the advantage of reducing air friction at the region of impact of the airflow with the splitter and it helps maintain airflow speed through the outlet silencer. Further an internal divider 245 in these splitters extending perpendicular to the central divider 234 is provided.

The space between each interior wall 220 and the exterior wall 212 is also divided into chambers by means of a series of internal dividers 246. Located inside these chambers and along the outer surface of interior wall 220 is one or more screen layers 248.

Figure 16:
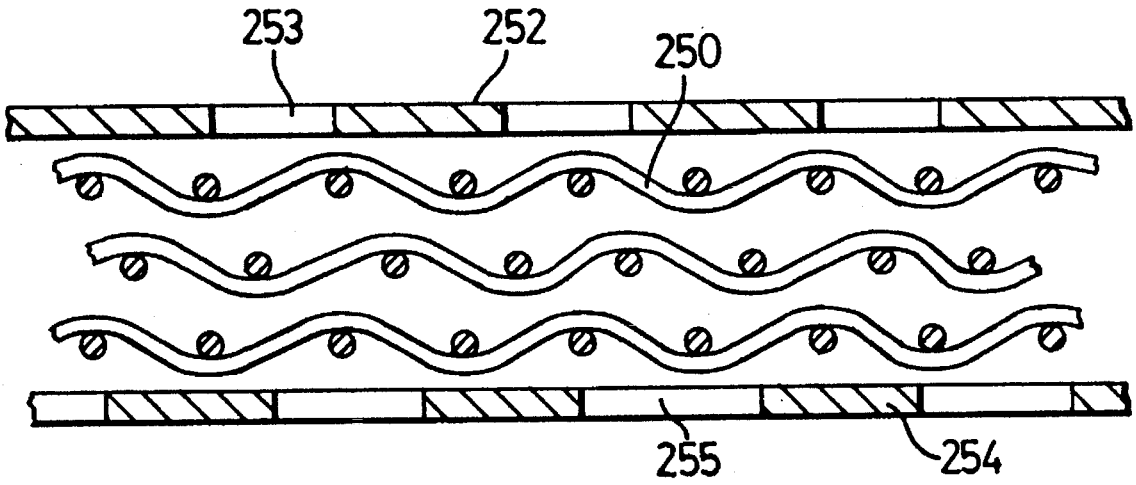
FIG. 16 is a cross-sectional detail of an alternative embodiment wherein screen layers are "sandwiched" between two perforated metal sheets.

FIG. 16 of the drawings illustrates an alternate form of sound attenuating system employing a sandwich-type construction. As illustrated, there are several layers of screens indicated at 250 sandwiched between the interior perforated wall having a large number of holes 253 and another perforated metal sheet 254. The sheet 254 is welded or otherwise connected to the interior perforated wall 252. It will be appreciated that one or more enclosed chambers are formed behind the perforated metal sheet 254 as in the embodiments of the invention illustrated in FIGS. 1 to 6. It is advantageous that the holes 255 in the sheet 254 be offset from the holes 253. This may be done in some cases by rotating the sheet 254 90 degrees or less with respect to the orientation of the perforated wall 252. Although more than one screen layer is shown in FIG. 16, it is possible of course to have only a single screen layer between the two perforated sheets. In this version of the invention, the open area of the individual perforated sheets can be as much as 40%.

Figure 7:
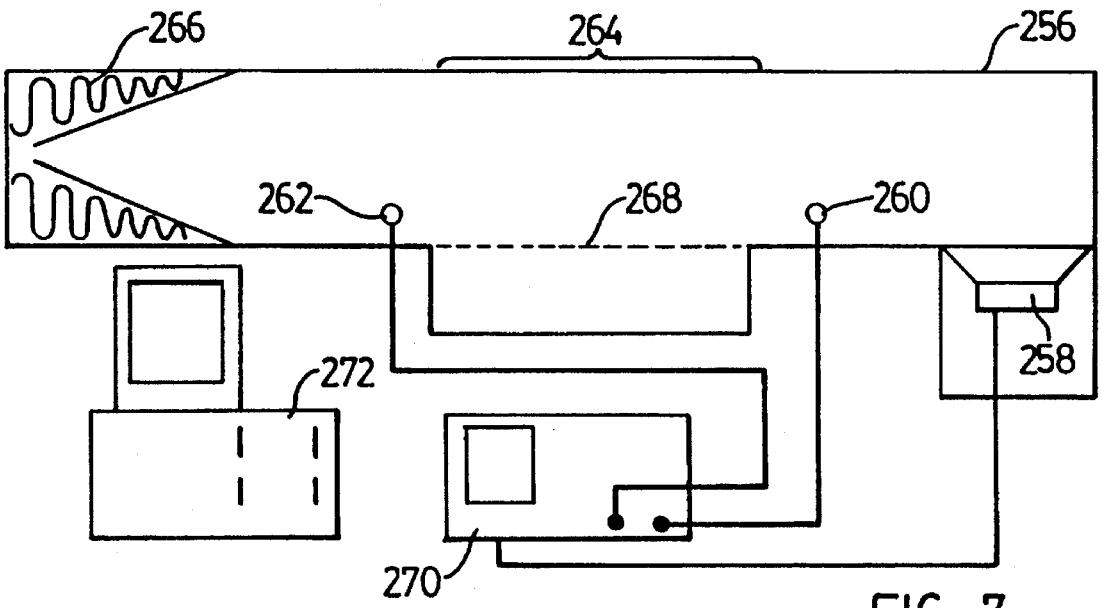
FIG. 7 is a schematic illustration of a dedicated laboratory apparatus for testing duct silencers constructed in accordance with the invention.

FIG. 7 illustrates schematically a duct test apparatus used to develop the system of the present invention in a testing facility. The apparatus consisted of a ten foot long rectangular duct 256 having a transverse cross-section measuring 12"×8". At one end of this duct a loud speaker 258 supplies "white noise" which travels down the duct. The travelling wave is measured by two microphones 260 and 262, one upstream and the other downstream of the test section indicated at 264. The duct is also fitted with an anechoic termination indicated at 266 to prevent reflection of acoustic energy back towards the test section. A wall of the duct indicated by a dashed line at 268 can be removed to permit installation of various silencing test units. Once a configuration was installed in the duct, the test was conducted using a special data-acquisition system comprising the two measuring microphones 262, 260, a dual channel spectrum analyzer 270 and a computer 272 which controlled the measurement, data storage and data analysis. The insertion loss of each configuration was measured by comparing the power spectra of the two microphones before and after the installation of the unit under test. The frequency range of interest was 100 Hz to 1100 Hz. The low frequency cut-off was chosen to reduce spurious noise from other activities in the area of the testing facility. The upper frequency cut-off was selected to avoid higher order propagation modes in the duct. Narrow band data as well as octave data was generated. The former proved to be more informative during the development phase of the invention. Composite sheet-screen systems were built by using commercial perforated sheet and layers of window screen. This was done to provide the maximum amount of flexibility in the screen properties. The use of this type of screening rather than metal screening was less expensive and reduced the cost of the tests. A flow resistance apparatus described hereinafter was used to identify the number of screen layers required to achieve the desired flow resistance.

Figure 8:
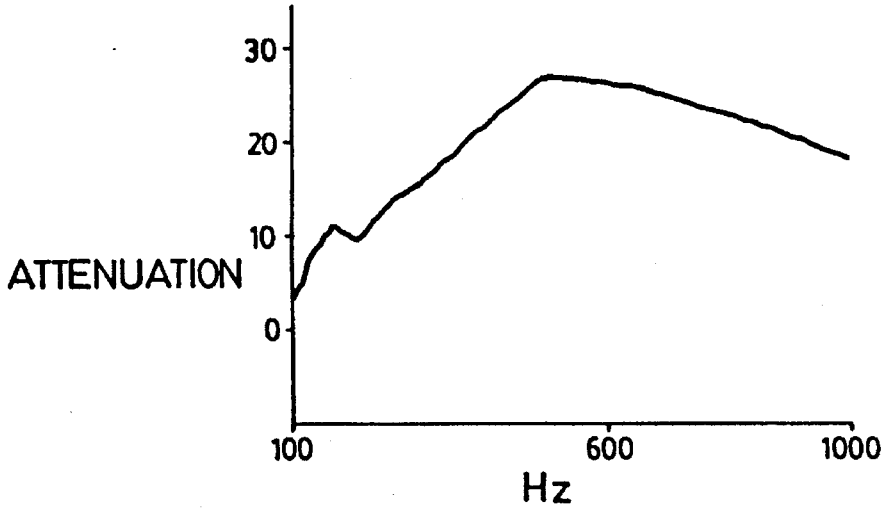
FIGS. 8 to 11 are four graphs of attenuation vs frequency, which graphs illustrate measured insertion loss of several duct silencers constructed in accordance with the invention.
Figure 9:
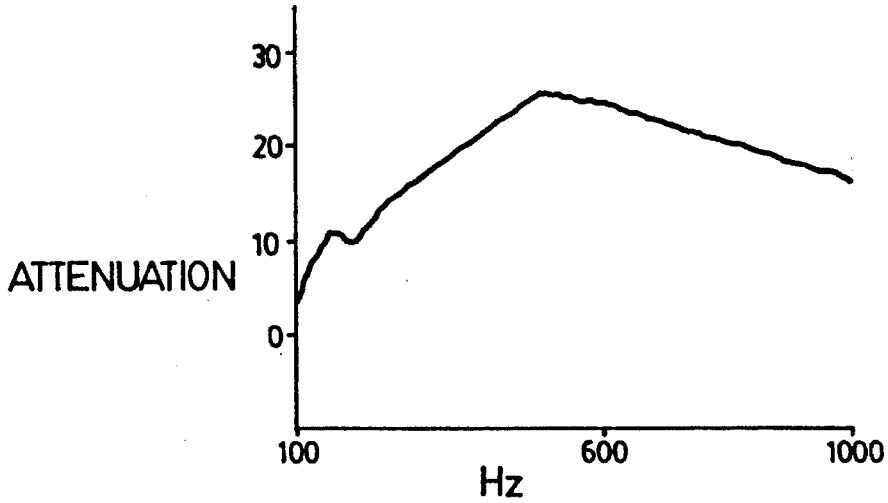
Figure 10:
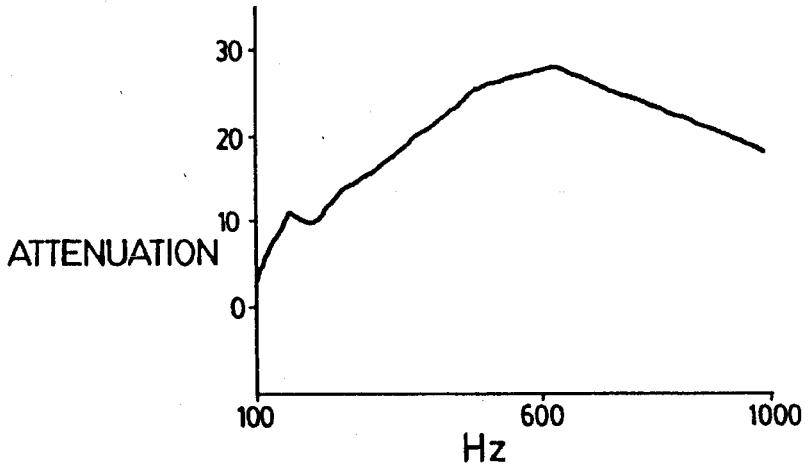
Figure 11:
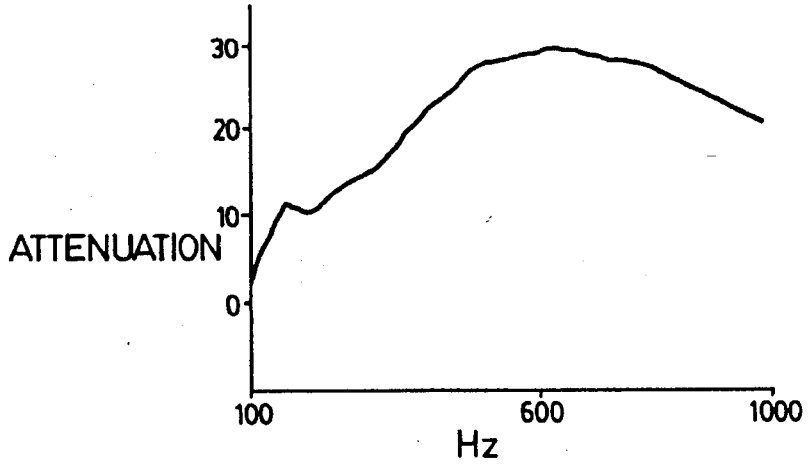

FIGS. 8 to 11 are graphs of attenuation vs frequency and show typical results for a variety of sheet-screen combinations. These graphs show that it is possible to construct a non-fibrous silencer using a perforated sheet-screen combination which has sound absorbing properties similar to those of conventional silencers whose sidewalls are packed with fibrous sound attenuating material. Over fifty different configurations were tested with the apparatus of FIG. 7. The graph of FIG. 8 shows the results of a test on a combination comprising four nylon window screens (standard mesh size) sandwiched between two perforated metal sheet, each sheet having 33% open area and perforated with 3/32nd inch diameter holes at 5/32nds staggered centers (similar to the configuration illustrated in FIG. 16). The graph of FIG. 9 illustrates the results of a test run on a combination comprising a single perforated metal sheet backed by four layers of nylon window screen. The graph of FIG. 10 illustrates the results of a test run on a combination of a single perforated metal sheet backed by six layers of nylon window screen. The graph of FIG. 11 illustrates the results of the tests run on a combination comprising six layers of nylon window screen sandwiched between two perforated metal sheets. In each of these test runs the same type of perforated metal sheets and screens were used.

The proper surface finish of a non-fibrous dissipative silencer determines its sound-absorbing abilities. The flow resistance of the material is a key parameter. The present invention uses a build up technique where two or more porous layers comprising perforated sheet metal and screens are used to make a composite structure having the desired properties. Although there are empirical formulae which predict the flow resistance of individual perforated sheets and screens, there is no theory which accurately predicts the properties of composite structures made by combining these perforated materials. Accordingly, in the development of the invention, a special flow resistance measurement system was designed and built, this system being illustrated in FIG. 13. This system permits one to measure the flow resistance of a circular sample of material which is placed in the test section.

Figure 13:
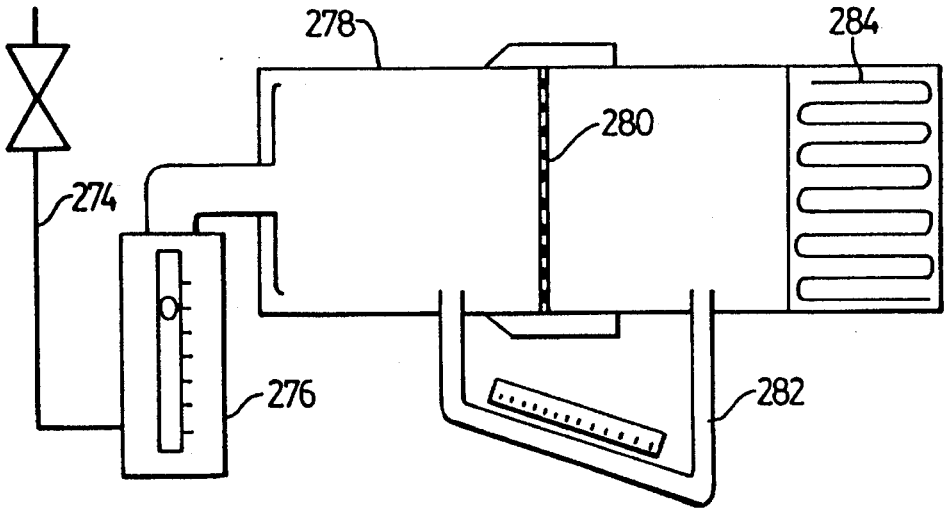
FIG. 13 is a schematic illustration of a flow resistance measurement apparatus capable of measuring the flow resistance of a circular sample of material placed in a test section.

In the apparatus of FIG. 13, compressed air, filtered and regulated to a suitable low pressure, is delivered to the apparatus through a pipe 274. This air passes through a flow meter 276 and then enters a test section 278 of circular cross-section. Static pressure upstream and downstream of a sample 280 under test is measured using an inclined manometer 282. At the end of the test duct is a short exhaust section 284 filled with compressed filter medium which provides a large flow resistance to ensure the flow velocity inside the test section is kept low. The measurement proceeds along the lines outlined in the reference work entitled "Noise and Vibration Control", 1971, pages 246–248 by Leo Baranek and published by McGraw-Hill. Pressure drop across the sample is plotted as a function of flow velocity. The data is fitted in a least squares sense with an equation of the form $$\Delta p = Ru + ru^2$$

Figure 12:
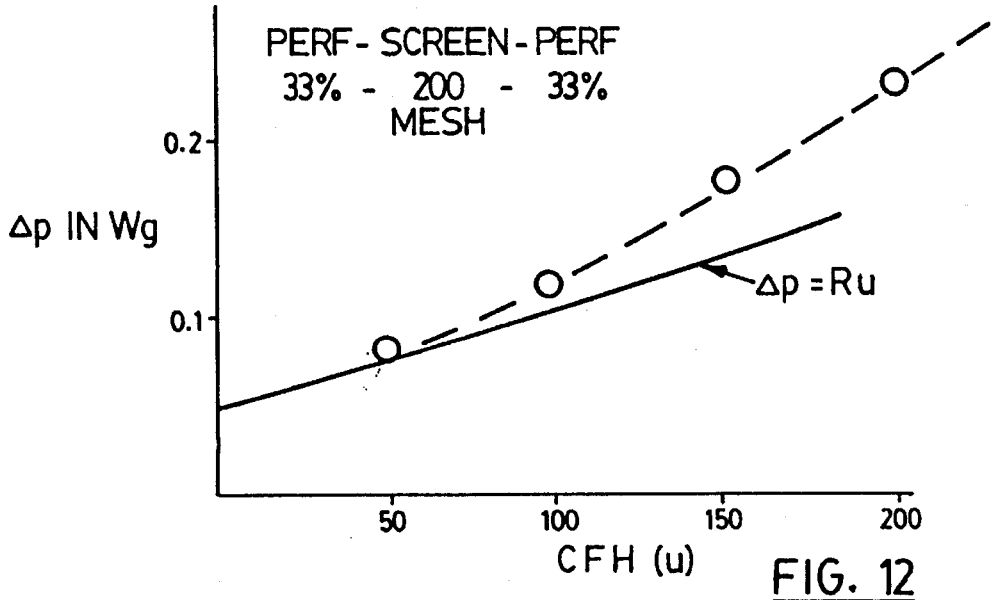
FIG. 12 is a graph of measured pressure drop as a function of flow velocity, this graph illustrating the result of tests for flow resistance of silencers of different construction.

The coefficient R is the flow resistance of the sample while r is the loss factor for the screen. Δp, of course, represents the pressure drop across the sample while u is flow velocity. Flow resistance of conventional fibrous materials as well as composite structures suitable for the duct silencers of the invention were tested. Some typical results of this testing are shown in the graph of FIG. 12 which is a graph of measured pressure drop as a function of flow velocity. The result illustrated is that for a sample comprising a sandwich composite consisting of two perforated metal sheets with 33% open area and a single screen layer of 200 mesh. The perforated metal sheets had holes measuring 3/32nd inch diameter at 5/32nd inch staggered centers. The dashed line represents the "best fit" line while the solid line represents the computed curve, that is, the curve which is generated by a computer using standard formula applied to each of the perforated metal sheets and the screen used. As indicated by the graph, the actual pressure drops generated are greater when these materials are combined than what is computed for the total of the individual sheets and screen by the computer.

These tests showed that composite systems behave in a non-linear manner. One can predict the flow resistance of a two-layered composite when the individual flow resistance flow values are known. However, the flow resistance of multiple layers is not simply the algebraic sum of the individual flow resistances. Normally, the flow resistance of the composite is greater than the sum of the individual flow resistances. Through trial and error testing, a set of suitable composite constructions was developed. This selection of the actual composite to be used in any particular duct silencer will be based in part on the ease with which it can be manufactured.

Figure 15:
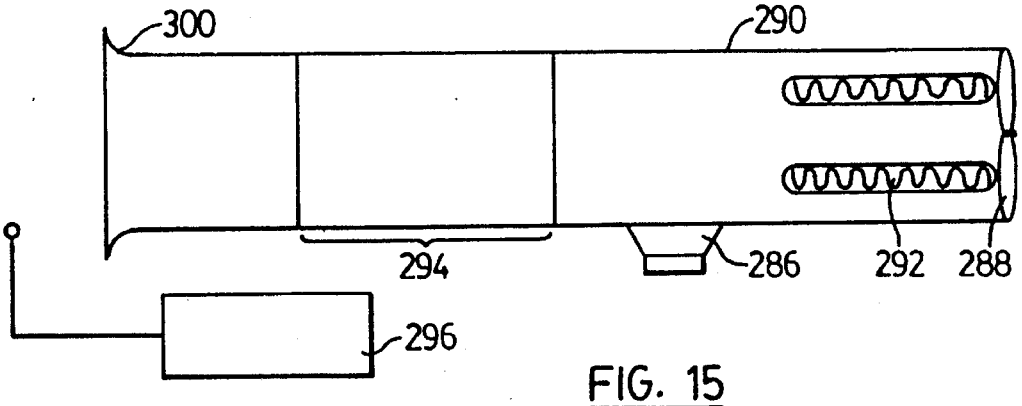
FIG. 15 is a schematic illustration of a duct silencer test facility designed for full scale testing of silencers constructed in accordance with the invention using a standard insertion loss measurement.

Full scale testing of a non-fibrous silencer constructed in accordance with the invention was conducted using a standard insertion loss measurement. This measurement requires several components which are illustrated in FIG. 15. The measurement apparatus includes a sound source 286, a suitable fan unit 288 located at the downstream end of a ductwork 290 that contains a system silencer 292 located downstream of the fan. The duct silencer being tested is installed in the apparatus at the location indicated at 294. The apparatus also comes equipped with a spectrum analyzer 296. The apparatus should be installed in a suitable measurement room. In the tests conducted by the inventors, the required quiet air flow was provided by a 20,000 CFM Compac Air-Handling unit manufactured by M & I Heat Transfer Products Ltd. of Mississauga, Ontario, Canada. This air handling unit has its own inlet and outlet silencers and radiates little noise. The acoustic test duct was a duct of square cross-section measuring 2'×2'. Air is drawn into the unit using a "bell-mouth" intake 300. There are provisions for flow straighteners and flow measurement probes. The silencer to be tested (or an untreated duct of equal length) is installed downstream of the inlet duct at 294. This is followed by the duct containing the controlled sound source 286, which source provides the acoustic signals which are to be used for silencer testing. The entire system is coupled to the air handling unit via a multi-sectioned diffuser. Flow velocities in the test section are controlled via the variable pitch of the fan in the air handling unit as well as by blocking secondary air-intakes of the air handling unit. The test procedure follows along the lines established for the measurement of insertion loss (ASTM standard). First the system self-noise is established by running the air handling unit with a controlled sound source turned off and the silencer to be tested installed in the duct. The sound pressure radiated from the test duct is measured by a microphone and processed with a signal analyzer configured for ⅓ octave analysis.

Figure 14:
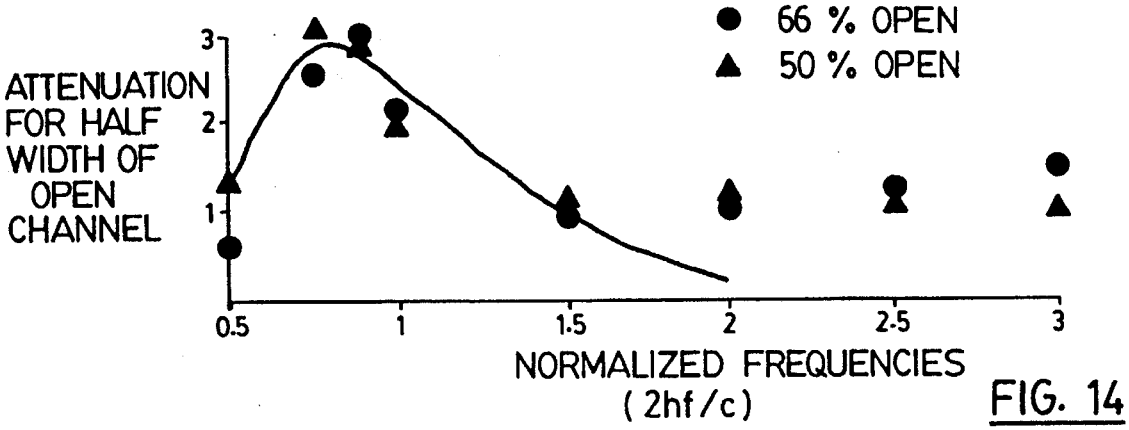
FIG. 14 is a graph of measured insertion loss for a duct silencer constructed in accordance with the invention, the graph illustrating some typical test results.

Then the sound source is turned on and the level adjusted until the levels received by the microphone are well above the noise floor established by the previous test. The desired excess is normally 10 dB, although somewhat lower levels can be used. The silencer is now removed and replaced by an untreated duct of equal length and the sound test is repeated with the same signal input to the sound source and the same volume flow through the system. The difference in the measured spectra of the last two cases is the insertion loss of the silencer. The test is repeated several times to reduce random errors. FIG. 14 illustrates some typical test results and shows measured insertion loss for two different types of non-fibrous duct silencers constructed in accordance with the invention. The graph is one of attenuation for half width of open channel vs normalized frequency defined as 2 hf/c. For purposes of these tests, the distance 2*h* (shown in FIG. 2) represents the width of each airflow passageway between the splitter and each adjacent perforated sidewall. The distance 2*y* represents the width of the splitter used (shown in FIG. 2), the distance y being the width of the chambers in the sidewalls. Thus, the silencer unit used was symmetrical about its central longitudinal axis. The circles on the graph indicate the results with a test unit employing splitter(s) providing 66% open area relative to the total cross-sectional area of the duct, while the results indicated by triangles are for a duct silencer employing splitter(s) providing 50% open area. In these tests, the perforated steel sheets had 1/16th inch diameter holes at 1/8th inch staggered centers. The gauge of sheet steel used was 22 gauge although the gauge is not significant from the standpoint of the results achieved. A single layer of stainless steel 200 mesh screen was used.

Table 1 set out below shows the decimal loss at various frequencies for three different lengths of both types of duct silencers constructed in accordance with the invention. The various duct lengths measured are 3 feet, 6 feet and 9 feet for each type.

| | Hz (Frequency) | | | | | | | | |
|---|---|---|---|---|---|---|---|---|---|
| | 63 | 125 | 250 | 500 | 1K | 2K | 4K | 8K | |
| Length of Duct | | | | | | | | | |
| 3' | 5 | 5 | 8 | 15 | 16 | 11 | 10 | 9 | TYPE 1 |
| 6' | 6 | 8 | 12 | 25 | 21 | 14 | 13 | 12 | (50% open |
| 9' | 8 | 13 | 16 | 30 | 26 | 19 | 18 | 17 | area) |
| dB | | | | | | | | | |
| 3' | 7 | 7 | 14 | 17 | 12 | 11 | 9 | 8 | TYPE 2 |
| 6' | 8 | 10 | 18 | 23 | 17 | 14 | 13 | 11 | (66% open |
| 9' | 10 | 15 | 21 | 28 | 21 | 18 | 16 | 15 | area) |

The airflow source, namely the aforementioned M & I Compac Air-Handling unit produced the following sound levels in the indicated frequency range:

| Hz | 63 | 125 | 250 | 500 | 1K | 2K | 4K | 8K |
|---|---|---|---|---|---|---|---|---|
| dB | 51 | 50 | 40 | 48 | 42 | 38 | 38 | 36 |

In a currently preferred embodiment of the invention, a single layer of 200 mesh stainless steel screen is used. This is a very fine metal screen that has strands with a diameter of only 0.0021 inch. A stainless steel screen of this type is available commercially from Tycan International of St. Catharines, Ontario, Canada. In the same preferred embodiment, the perforated steel sheet to which it is attached has an open area of about 23%. The open area of the steel sheets used in the invention can range from 23% to 63%. It is possible to use sheets with an open area less than 23% but such sheets are not commercially available.

Rather than stainless steel screens, it is also possible to use mild steel screens or plastic screens but, if such screens are used, it is preferable to use two or more layers of screens.

The size of the numerous holes in the sheet steel can vary depending on the desired sound attenuation, the screens with which it is used, etc. However, these holes can for example range in size from 0.032 to ¼ inch. Stainless steel is preferred for the perforated sheets, at least if the screen layer is to be welded thereto (avoids burning the screen).

The enclosed chambers formed along the walls of the duct silencer are "tuned" so as to achieve the desired sound attenuation at a certain sound frequency that will be generated in the system. The reactance of these chambers is a function of their depth, that is the distance between the composite facing panel and the exterior wall of the silencer. In other words, the depth of these enclosed chambers is a function of the frequency at which maximum attenuation is desired. Thus these chambers are sized according to the characteristics of the system for which the particular silencer is designed to prevent resonance within each cavity. Although the internal partitions that form ends of these chambers are shown at some locations as extending perpendicular to the composite facing panel, it will be appreciated that it is not necessary for these partitions to be in fact perpendicular to the composite facing panel. It may be preferred in these enclosed chambers to avoid, where possible, walls that extend parallel to one another in order to achieve maximum sound attenuation.

It will be appreciated by those skilled in this art that the duct silencer constructed in accordance with the invention has several advantages in addition to its capability of reducing sound transmitted through the duct. For example, the use of one or more screen layers behind the perforated sheet metal helps reduce pressure loss in the duct system. Furthermore, because duct silencers constructed in accordance with the invention avoid the use of fibreglass packing, they avoid the need for a material which can be dangerous, at least in some applications, and which cannot be easily cleaned. In fact, the duct silencers of the invention can be easily cleaned by means of chemical scrubbing.

It will be further appreciated that the one or more layers of screens that are used must be fastened or anchored securely, particularly along their edges and ends and they must not be allowed to be loose or to flap during use of the silencer duct.

The gauge of the perforated sheet steel used can vary. Perforated sheet steel from 11 to 24 gauge is available and could be used. However, 22 gauge steel is the type currently in use.

It will be apparent to those skilled in this art that various modifications and changes can be made to the described silencer ducts of the invention without departing from the spirit and scope of this invention. Accordingly, all such modifications and changes are intended to be part of this invention.

We therefore claim:

1. A non-fibrous acoustic silencing duct member capable of attenuating noise associated with a gaseous medium passing through the duct member, said duct member comprising:

perforated sidewalls at least partially defining a gas flow passageway, said sidewalls including at least two opposing walls, each of which is perforated with a number of small holes distributed over the surface of the wall;

exterior sidewalls positioned on the outside of said perforated sidewalls and spaced therefrom with enclosed chambers being formed between said perforated and exterior sidewalls, said chambers being of selected depth;

one or more screen layers extending along and adjacent to outer surfaces of said perforated sidewalls, said screen layers being located in said chambers, each screen layer being covered with an array of very small holes that are substantially smaller than said holes in the adjacent perforated sidewall;

means for firmly attaching the one or more screen layers to its respective interior sidewall; and internal dividing means extending generally between each perforated sidewall and its respective, adjacent exterior sidewall in order to divide the space between these sidewalls into two or more of said chambers.

2. A duct member according to claim 1 wherein said perforated sidewalls are made of sheet metal and said screen layers are metal screens.

3. A duct member according to claim 2 wherein said gas flow passageway is straight and elongate and extends from one end of said duct member to an opposite end thereof and said perforated sidewalls extend completely around said passageway.

4. A duct member according to claim 2 wherein said screen layers are spot welded to their respective perforated sidewalls.

5. A duct member according to claim 2 wherein one or more of said screen layers is sandwiched between its respective perforated sidewall and another perforated metal sheet connected to the perforated sidewall, said another metal sheet acting to hold the screen layer in place and having holes therein which are offset from those in the adjacent perforated sidewall.

6. A duct member according to claim 2 wherein said screen layers are rivetted to their respective perforated sidewalls.

7. A duct member according to claim 2 wherein said screen layers are made of stainless steel.

8. A duct member according to claim 7 wherein said perforated sidewalls are open to the extent of at least 20% of their total area.

9. A duct member according to claim 3 wherein said internal dividing means are arranged and mounted so that the dimension of each chamber in the lengthwise direction of said passageway does not exceed about one foot.

10. A duct member according to claim 2 wherein said screen layers have a fineness in the range of 150 to 200 mesh.

11. An acoustic silencer for use in a airflow duct for attenuating noise passing along said duct, said silencer comprising:

perforated sidewalls defining and surrounding an elongate airflow passageway having an inlet at one end of said sidewalls and an outlet at an opposite end thereof, said sidewalls having a large number of small holes distributed over their surfaces, exterior sidewalls extending around the outside of said perforated sidewalls and spaced therefrom;

means for mounting said perforated sidewalls in said exterior sidewalls; and at least one screen layer mounted on an outer surface of each perforated sidewall away from the airflow passageway, said at least one screen layer being formed with very small holes extending over its surface, which holes are substantially smaller than said holes in each perforated sidewall;

wherein enclosed chambers are formed between the perforated sidewalls and adjacent exterior sidewalls.

12. An acoustic silencer according to claim 11 wherein said perforated sidewalls are made of sheet steel and said at least one screen layer comprises metal screen.

13. An acoustic silencer according to claim 12 wherein said airflow passageway is straight and mounted therein is at least one splitter having perforated sidewalls extending longitudinally in said passageway, at least one screen layer being mounted on an inner surface of each splitter sidewall away from the adjacent airflow passageway.

14. An acoustic silencer according to claim 13 wherein the or each splitter has a central, non-perforated, dividing wall extending generally parallel to the sidewalls of the splitter, said dividing wall reducing or preventing direct sound transmission from one splitter sidewall to the other.

15. An acoustic silencer according to claim 12 wherein said silencer is a fan outlet silencer adapted for mounting downstream of a fan unit, said silencer having a round inlet into said passageway and a central elongate silencing member positioned in said passageway, said silencing member having a perforated sidewall exterior which is backed with at least one screen layer located on the surface of said sidewall exterior away from the airflow.

16. An acoustic silencer according to claim 12 wherein said at least one screen layer comprises fine mesh stainless steel screen.

17. An acoustic silencer according to claim 16 wherein said enclosed chambers are separated by internal dividers extending between each perforated sidewall and the adjacent exterior sidewall.

18. An acoustic silencer according to claim 17 wherein the depth of the enclosed chambers in a direction generally perpendicular to the adjacent perforated sidewalls is selected to maximize sound attenuation at a predetermined sound frequency.

19. An acoustic silencer according to claim 12 wherein the depth of the enclosed chambers in a direction generally perpendicular to the adjacent perforated sidewalls is selected to maximize sound attenuation at a predetermined sound frequency.

20. An acoustic silencer according to claim 19 wherein said enclosed chambers are separated by internal dividers extending between each perforated sidewall and the adjacent exterior sidewall.

21. A sound attenuating duct unit for transmitting an airflow along an air duct, said unit comprising a housing having sidewalls surrounding an airflow passageway, an air inlet at one end of said passageway, and an air outlet at the other end thereof, said sidewalls including interior perforated walls extending along and defining said airflow passageway, said interior walls having a large number of small holes distributed over their surfaces, at least one layer of screen material disposed along an outer surface of one or more of said interior perforated walls away from said airflow passageway, wherein said sidewalls form enclosed chambers located along said outer surface of said one or more interior perforated walls.

22. A duct unit according to claim 21 wherein said perforated walls are made of sheet metal and said screen material is a fine mesh metal screen.

23. A duct unit according to claim 22 wherein said chambers are substantially hollow and contain no non-metallic fibrous material.

24. A duct unit according to claim 23 wherein said duct unit is adapted for placement at an inlet of an air supply fan unit for a building, said airflow passageway is annular at said air outlet, and said air inlet is arranged to be symmetrical about a central axis of said air outlet.

25. A duct unit according to claim 23 wherein said duct unit is adapted for placement at an outlet of an air supply fan unit for a building, said airflow passageway is annular at said air outlet, and at least one airflow defining member is mounted in said passageway and has perforated sidewalls, at least one layer of screen material being disposed along inner surfaces of said perforated sidewalls of the or each airflow defining member.

26. A duct unit according to claim 22 wherein at least one layer of screen material is disposed along and adjacent the outer surfaces of all said interior perforated walls.

27. A duct unit according to claim 26 wherein said screen material is made of stainless steel.

28. A duct unit according to claim 27 wherein the depth of the enclosed chambers in a direction generally perpendicular to the adjacent perforated wall is selected to maximize sound attenuation at a predetermined sound frequency.

29. A duct unit according to claim 25 wherein said enclosed chambers are separated by internal dividers extending between each interior perforated wall and an exterior wall of said housing.

30. A duct unit according to claim 29 wherein the dimension of said enclosed chambers in the lengthwise direction of said passageway does not exceed about two feet.

31. A sound attenuating duct unit for transmitting an airflow along an air duct, said unit comprising a housing having sidewalls surrounding an airflow passageway, an air inlet at one end of said passageway, an air outlet at the other end thereof, and at least one airflow defining member in said housing and extending generally in the lengthwise direction of said passageway, said member having one or more perforated walls extending along and adjacent said passageway, the or each perforated wall having a large number of small holes distributed over its surface, and at least one layer of screen material disposed along a surface of the or each perforated wall away from the airflow passageway, wherein one or more enclosed chambers are positioned along the or each perforated wall on the side thereof opposite the airflow passageway.

32. A duct unit according to claim 31 wherein the or each perforated wall is made of sheet metal and said screen material is a fine mesh metal screen.

33. A duct unit according to claim 32 wherein said chambers are substantially hollow and contain no non-metallic fibrous material.

34. A duct unit according to claim 33 wherein there is a single layer of stainless steel screen disposed along said surface of the or each perforated wall.

35. A duct unit according to claim 32 wherein said at least one airflow defining member is an airflow splitter having generally flat perforated sidewalls extending from one sidewall of the housing to an opposite sidewall thereof.

* * * * *